United States Patent [19]

Guelich

[11] Patent Number: 4,892,459

[45] Date of Patent: Jan. 9, 1990

[54] AXIAL THRUST EQUALIZER FOR A LIQUID PUMP

[76] Inventor: Johann Guelich, Burgstrasse 62b CH8408, Winterthur, Switzerland

[21] Appl. No.: 283,612

[22] Filed: Dec. 13, 1988

Related U.S. Application Data

[63] Continuation of Ser. No. 922,069, Oct. 20, 1986, abandoned.

[30] Foreign Application Priority Data

Nov. 27, 1985 [CH] Switzerland ..... 5066/85-7

[51] Int. Cl.[4] ..... F01D 3/04

[52] U.S. Cl. ..... 415/104; 415/107

[58] Field of Search ..... 415/104, 106, 107, 168, 415/169 R, 169 A

[56] References Cited

U.S. PATENT DOCUMENTS

| | | | |
|---|---|---|---|
| 3,280,750 | 10/1966 | White | 415/169 |
| 3,671,137 | 6/1972 | Ball | 415/104 |
| 4,256,436 | 3/1981 | Fandrey et al. | 415/168 |
| 4,493,610 | 1/1985 | Iino et al. | 415/170 B |

FOREIGN PATENT DOCUMENTS

| | | | |
|---|---|---|---|
| 1276208 | 3/1962 | France | 415/104 |

*Primary Examiner*—Margaret A. Focarino
*Assistant Examiner*—John T. Kwon
*Attorney, Agent, or Firm*—Kenyon & Kenyon

[57] ABSTRACT

The sleeve of the axial-thrust equalizer is provided with radial bores which deliver working liquid to the annular gap between the sleeve and dummy piston without pre-rotation. The delivered liquid divides within the annular gap so that a sub-flow of liquid is returned to the contiguous pump chamber to prevent pre-rotating liquid from entering directly into the gap from the pump chamber.

18 Claims, 1 Drawing Sheet

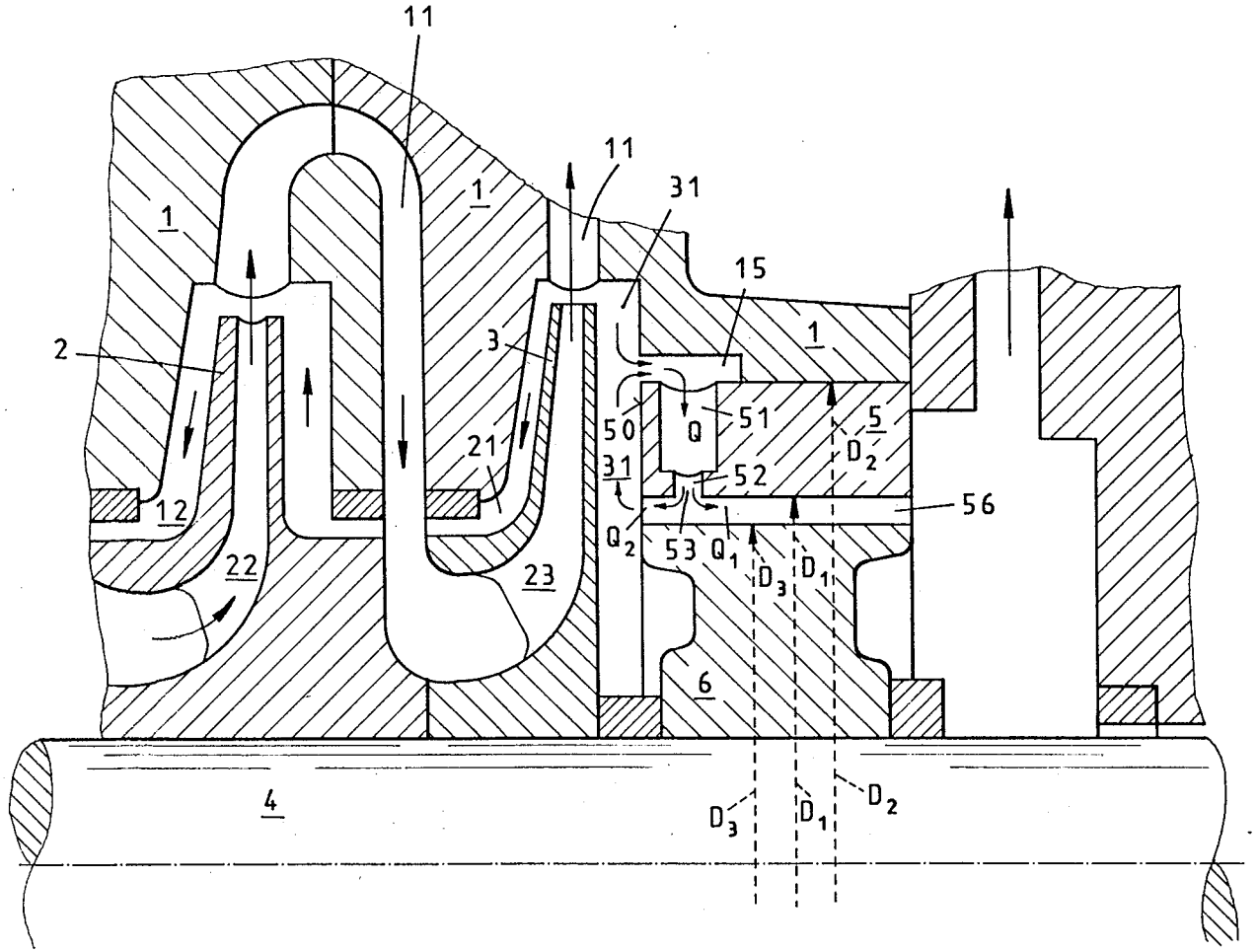
56
5
D2
1
D1
D3
15
51
52
Q1
Q
53
6
31
50
31
Q2
11
23
3
21
11
1
4
22
1
12
2

AXIAL THRUST EQUALIZER FOR A LIQUID PUMP

This is a continuation of application Ser. No. 922,069, filed Oct. 20, 1986, now abandoned.

This invention relates to an axial-thrust equalizer for a liquid pump.

As is known, various types of axial-thrust equalizers have been used in liquid pumps, particularly, in multistage high performance radial-flow pumps in order to neutralize or reduce large axial thrusts. Generally, an axial-thrust equalizer is composed of a stationary sleeve and a rotatable dummy piston which is disposed within the sleeve and rigidly secured to a pump rotor shaft in spaced relation to the sleeve. The sleeve may also be an independent part which is rigidly secured to the pump housing or a part which is formed directly on the pump housing. Likewise, the dummy piston can be a part of the rotor shaft or a separate part which is rigidly secured to the shaft. Usually, the equalizer is disposed after the final downstream stage of the pump.

During operation, the pressure relationships in the liquid near the equalizer are such that the working liquid flows continuously from a rotor side chamber into and through the gap between the sleeve and the dummy piston. However, The working liquid is set into rotation in the chamber with an intensity which rises with the throughflow through the gap. Thus, the working medium enters the gap with a peripheral component. As a result, the rotation of the working medium may reduce the maximum output of the pump by increasing the tendency of the rotor to oscillate at its natural frequency.

The conventional solutions which have been attempted to reduce the rotation of the working medium in a rotor side chamber have relied upon baffles, such as ribs, grooves and the like. However, the liquid entering the gap on the rotor side still has a reduced rotary component known as "pre-rotation".

Accordingly, it is an object of the invention to preclude the entry of a pre-rotating liquid into the gap of an axial-thrust equalizer in a liquid pump.

It is another object of the invention to provide an axial thrust equalizer of relatively simple construction which precludes pre-rotation of a working liquid.

It is another object of the invention to permit the retro-fit of existing liquid pumps with an improved axial-thrust equalizer.

It is another object of the invention to supply a gap of an axial-thrust equalizer with non-prerotating liquid without resorting to elaborate additional facilities.

Briefly, the invention provides an axial-thrust equalizer for a liquid pump which is comprised of a dummy piston and a stationary sleeve which is spaced from the dummy piston to define an annular gap wherein the sleeve has a plurality of ducts extending inwardly from an outer periphery to the gap in order to guide a flow of working liquid from the chamber contiguous with the sleeve into the gap. In addition, the ducts communicate with the gap in order to permit a delivered flow of working liquid to divide into two sub-flows with each sub-flow moving towards a respective opposite end of the gap. In this way, one sub-flow is returned to the chamber contiguous to the sleeve in order to prevent pre-rotating liquid from entering the gap from the chamber.

Since only liquid which is still not pre-rotating is supplied to the gap through the ducts, rotation of the liquid in the gap and in the pump chamber on the rear of the rotor is reduced. Hence, the rotor has less tendency to vibrate at its natural frequency in the limit load range and therefore permits increased outputs for given pump rotor shaft dimensions.

The axial-thrust equalizer is particularly advantageous for multistage high-speed high-pressure radial-flow pumps, such as boiler feed pumps. For example, where the pump is provided with a housing, a shaft rotatably mounted in the housing and at least one rotor mounted on the shaft within the housing and spaced from the housing to define a pump chamber for the delivery of a working liquid, the dummy piston of the equalizer is disposed on the shaft and the sleeve is mounted in the housing spaced from the dummy piston to define the annular gap. Further, the ducts in the sleeve communicate the pump chamber with the annular gap in order to guide a flow of the working liquid into the gap as described above.

These and other objects and advantages of the invention will become more apparent from the following detailed description taken in conjunction with the accompanying drawing wherein:

The Figure illustrates a partial axial cross-sectional view of a radial-flow pump having an equalizer in accordance with the invention.

As illustrated, the radial-flow pump has a single-element or multi-element stationary pump housing 1 wherein two pump rotors 2, 3 are mounted on a pump rotor shaft 4 which, in turn, is rotatably mounted in the housing 1. Of note, the illustrated rotors 2, 3 constitute the final stages of the pump. As indicated, each rotor 2, 3 has a duct 22, 23, respectively through which liquid flows as indicated by the arrows therein. In addition, flow ducts 11 are disposed within the housing 1 while secondary pump chambers 12, 21, 31 are disposed between the rotors 2, 3 and the housing 1. The flow of liquid within these ducts 11 and chambers 12, 21, 31 is indicated by arrows.

An axial-thrust equalizer is disposed within the pump housing 1 downstream of the last rotor 3. To this end, the equalizer comprises a sleeve 5 which is rigidly secured to the housing 1 and a dummy piston 6 which is rigidly secured to the rotor shaft 4 to rotate with the shaft 4 within the sleeve 5. In addition, the sleeve 5 is spaced from the dummy piston 6 to define an annular gap 56 of uniform radio width and is formed with a plurality of ducts 51, only one of which is shown. These ducts 51 extend radially inwardly from an outer periphery of the sleeve 5 to the inner annularly groove 52 which communicates with the gap 56 between the sleeve 5 and the piston 6. The gap 56 communicates directly with the contigous pump chamber 31 on one side for purposes as described below.

The housing 1 includes an inner annular recess 15 about the upstream end of the sleeve 5 and communicates the contiguous pump chamber 31 with the ducts 51.

During operation of the pump, liquid flows from the duct 23 in the last rotor 3 into the pump side chamber 31 in a secondary flow. In the absence of the recess 15, ducts 51 and grooves 52, the working liquid in the pump chamber 31 would flow radially inwardly to the gap 56 between the sleeve 5 and the piston 6. In addition, the working liquid in the pump chamber 31 would have a rotary movement imparted thereto in the direction of the rotation of the rotor 3. This rotary movement is known as "pre-rotation". The pre-rotation becomes greater in proportion as the quantity of liquid flowing into the gap 56 is greater.

In the illustrated embodiment, the inflow of prerotating working liquid to the end of the gap 56 which is near the rotor 3 is totally obviated by working liquid which is free of pre-rotation and which is supplied by way of the ducts 51 and groove 52 to the gap 56 between the two ends thereof.

As indicated by the arrows in the illustrated embodiment, during operation, the secondary flow of working liquid in the pump chamber 31 passes through the annular recess 15 in the housing 1 into the ducts 51 and is delivered through the annular groove 52 into the gap 56.

From there, the working liquid divides into two sub-flows at the area 53, each of which moves towards a respective end of the gap 56. Further, the sub-flow which represents a proportion $Q_2$ of the total liquid flow Q through the ducts 51 and groove 52 returns through the gap 56 to the side chamber 31 and thus provides a total barrier effect which prevents pre-rotating liquid from entering the gap 56 from the chamber 31. The other sub-flow which represents a proportion $Q_1$ flows to the downstream end of the gap 56.

The ducts 51 are illustrated as radial bores which extend from the circumferential periphery of the sleeve 6 to the annular groove 52. However, the ducts 51 may also extend angularly of the longitudinal axis of the sleeve 5. The ducts 51 may also be disposed oppositely to the direction to pump rotation, thus, further decreasing rotation of the working liquid in the gap 56.

In the illustrated embodiment, the ducts 51 are disposed in a common place transverse to the longitudinal axis of the sleeve 6 while the groove 52 is disposed in the same plane.

The annular groove 52 is operative to ensure that the working liquid is supplied to the gap 56 uniformly over the periphery of the piston 6 and, thus, to provide very uniform pressure relationships over the periphery. However, the groove 52 may be omitted and the ducts 51 may extend directly into the gap 56.

In the illustrated embodiment, the working liquid is supplied to the ducts 51 by way of the recess 15. However, the recess 15 can be omitted and the ducts 51 may communicate directly with the side chamber 31 by way of a lateral bore (not shown) in the sleeve 5 or by way of inclined bores in the housing 1.

The flow by way of the recess 15, ducts 51 and groove 52 to the gap 56 and the return flow proportion to the gap and near the rotor 3 into the chamber 31 is produced as follows:

Rotation of the rotor 3 produces a rotating flow of the working liquid in the chamber and, therefore, an outwardly directed radial pressure gradient. The relationships must be such that, in operation, the radial pressure difference in the side chamber 31 between the sleeve outer diameter $D_2$ and the sleeve inner diameter $D_1$ is greater than the pressure drop in the ducts 51 and groove 52 in the event of a throughflow $Q_1$ alone. When this condition is operative, a barrier flow $Q_2$ flows from the gap 56 towards the rotor-side end of the gap 56 into the side chamber 31 and also completely prevents any prerotating working liquid from entering the gap 56.

Advantageous conditions in a high-speed multistage high-pressure radial-flow pump can be produced, for example, when the ratio of sleeve outer diameter to sleeve inner diameter—i.e., the ratio $D_2/D_1$ is at least 1.25:1 and the sum of the cross-sectional areas of the radial ducts 51 is at least three times the cross-sectional area of the gap 56 and when the radial bores 51 are disposed at a spacing of just a few millimeters near the upstream end face 50 of the sleeve 5.

Further, by way of example, twenty-four ducts 51 may be provided at equiangular spacings of 15° from each other about the periphery of the sleeve 5.

Given appropriate dimensioning and arrangement of the bores 51, groove 52, sleeve outer diameter $D_2$, sleeve inner diameter $D_1$ and the outer diameter $D_3$ of the dummy piston 6, the flow relationships in this zone are as indicated by the arrows. A pump expert can readily determine a suitable form for the axial-thrust equalizer for a particular kind of pump.

The invention thus provides an axial-thrust equalizer having an annular gap wherein prerotation of a liquid flow in the gap is prevented in a relatively simple manner.

Further, the invention provides an axial-thrust equalizer which reduces the tendency of a pump rotor to vibrate at its natural frequency in a limit load range. In this regard, the invention also provides an axial-thrust equalizer which enables a pump output to be increased.

| Numerical Examples: | Example 1 | Example 2 | Example 3 |
|---|---|---|---|
| Outer diameter $D_1$ of sleeve 5 in mm | 520 | 400 | 300 |
| Diameter of bores 51 in mm | 12 | 9 | 7 |
| Width of groove 52 in mm | 9 | 7 | 5.5 |
| Depth of groove 52 in mm | 6 | 5 | 4 |
| Distance center bore 51 to face 50 in mm | 10 | 9 | 7 |
| sum cross-section bores 51 to cross-section gap 56 | 3.3 | 3.1 | 3.4 |
| if $D_2:D_1 = 1.27:1$ | and twenty-four bores 51 | | |

Intermedate sizes may be calculated by interpolation.

What is claimed is:

1. An axial thrust equalizer for a liquid pump comprising a dummy piston for securement to a pump rotor shaft; and a stationary sleeve spaced from said dummy piston to define an annular gap of uniform radial width therebetween, said sleeve having a plurality of ducts extending inwardly from an outer periphery to said gap to guide a flow of working liquid from a pump chamber contiguous with said sleeve and said piston into said gap, said ducts communicating with said gap to permit a delivered flow of working liquid to divide into two sub-flows with one sub-flow returning into the pump chamber to prevent rotating liquid in the pump chamber from entering into said gap wherein the ratio of the outer diameter of said sleeve to the inner diameter of said sleeve is at least 1.25:1 and the sum of the cross-sectional areas of said ducts is at least three times the cross-sectional area of said gap.

2. An axial-thrust equalizer as set forth in claim 1 wherein said ducts are equi-spaced bores extending to a circumferential periphery of said sleeve.

3. An axial thrust equalizer as set forth in claim 2 wherein said sleeve includes an inner groove communicating with said ducts and opening into said gap.

4. An axial-thrust equalizer as set forth in claim 3 wherein said ducts are disposed in a common plane transverse to a longitudinal axis of said sleeve and said groove is an annular groove in said plane.

5. An axial-thrust equalizer as set forth in claim 2 wherein said ducts are radial bores.

6. An axial-thrust equalizer as set forth in claim 1 wherein said ducts extend angularly of a longitudinal axis of said sleeve.

7. An axial-thrust equalizer as set forth in claim 1 wherein said sleeve includes twenty-four radial ducts distributed uniformly at equiangular spacings of 15° from each other about said sleeve periphery.

8. An axial-thrust equalizer as set forth in claim 1 wherein said ducts are disposed near a rotor-side end face of said sleeve.

9. In a pump, the combination comprising a housing;

a shaft rotatably mounted in said housing;

at least one rotor mounted on said shaft within said housing and spaced from said housing to define a pump chamber for delivery of a working liquid thereto;

a dummy piston on said shaft; and a sleeve mounted in said housing and spaced from said dummy piston to define an annular gap therebetween with said gap communicating at one end with said pump chamber, said sleeve having a plurality of ducts communicating said pump chamber with said gap to guide a flow of the working liquid into said gap, said ducts communicating with said gap to permit a delivered flow of working liquid in said gap to divide into two sub-flows with one sub-flow returning into said pump chamber to prevent pre-rotating liquid in said chamber from entering said gap and the other sub-flow moving towards an opposite end of said gap.

10. The combination as set forth in claim 9 wherein said dummy piston is secured to said shaft.

11. The combination as set forth in claim 10 wherein said housing includes an inner recess about one end of said sleeve and communicating said pump chamber with said ducts.

12. The combination as set forth in claim 9 wherein said ducts are radial bores.

13. An axial thrust equalizer for a liquid pump comprising a dummy piston for securement to a pump rotor shaft;

a stationary sleeve spaced from said dummy piston to define an annular gap therebetween, said sleeve having a plurality of ducts extending inwardly from an outer periphery to said gap to guide a flow of working liquid from a chamber contiguous with said sleeve into said gap, said ducts communicating with said gap to permit a delivered flow of working liquid to divide into two sub-flows with each sub-flow moving towards a respective opposite end of said gap; and wherein the ratio of the outer diameter of said sleeve to the inner diameter of said sleeve is at least 1.25:1 and the sum of the cross-sectional areas of said ducts is at least three times the cross-sectional area of said gap.

14. An axial-thrust equalizer as set forth in claim 13 wherein said ducts are equi-spaced bores extending to circumferential periphery of said sleeve.

15. An axial-thrust equalizer as set forth in claim 14 wherein said sleeve includes an inner groove communicating with said ducts and opening into said gap.

16. In a pump, the combination comprising a housing;

a shaft rotatably mounted in said housing;

at least one rotor mounted on said shaft within said housing and spaced from said housing to define a pump chamber for delivery of a working liquid thereto;

a dummy piston on said shaft; and a sleeve mounted in said housing and spaced from said dummy piston to define an annular gap therebetween, said sleeve having a plurality of ducts communicating said pump chamber with said gap to guide a flow of the working liquid into said gap, said ducts communicating with said gap to permit a delivered flow of working liquid to divide into two sub-flows with each sub-flow moving towards a respective opposite end of said gap wherein the ratio of the outer diameter of said sleeve to the inner diameter of said sleeve is at least 1.25:1 and the sum of the cross-sectional areas of said ducts is at least three times the cross-sectional area of said gap.

17. The combination as set forth in claim 16 wherein said housing includes an inner recess about one end of said sleeve and communicating said pump chamber with said ducts.

18. In a pump, the combination comprising a housing;

a shaft rotatably mounted in said housing;

at least one rotor mounted on said shaft within said housing and spaced from said housing to define a pump chamber for delivery of a working liquid thereto;

a dummy piston on said shaft; and a sleeve mounted in said housing and spaced from said dummy piston to define an annular gap therebetween with said gap opening at one end into said pump chamber, said sleeve having a plurality of ducts communicating said pump chamber with said gap to guide a flow of the working liquid into said gap, said ducts communicating with said gap to permit a delivered flow of working liquid to divide into two sub-flows with one sub-flow returning into said pump chamber to prevent pre-rotating liquid in said chamber from entering said gap and the other sub-flow moving towards an opposite end of said gap, and wherein the ratio of the outer diameter of said sleeve to the inner diameter of said sleeve is at lest 1.25:1 and the sum of the cross-sectional areas of said ducts is at least three times the cross-sectional area of said gap.

* * * * *